US010053263B2

(12) United States Patent
Tseng et al.

(10) Patent No.: US 10,053,263 B2
(45) Date of Patent: Aug. 21, 2018

(54) TEARABLE CONTAINER CLOSURE AND ENVELOPE COMPRISING SAME

(71) Applicant: INTEPLAST GROUP CORPORATION, Livingston, NJ (US)

(72) Inventors: Ben Tseng, Somerset, NJ (US); Ter Hai Lin, Sugar Land, TX (US); Ting Li, Port Lavaca, TX (US); Kelvin Yang, Madison, NJ (US); Lan-Shin Cheng, Port Lavaca, TX (US); Jyh-yao Raphael Li, Parsippany, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 15/243,468

(22) Filed: Aug. 22, 2016

(65) Prior Publication Data

US 2017/0050768 A1 Feb. 23, 2017

Related U.S. Application Data

(60) Provisional application No. 62/208,288, filed on Aug. 21, 2015.

(51) Int. Cl.

| | |
|---|---|
| ***B65D 27/38*** | (2006.01) |
| ***B65D 27/16*** | (2006.01) |
| ***B65D 27/14*** | (2006.01) |

(52) U.S. Cl.

CPC ..... *B65D 27/38* (2013.01); *B65D 27/14* (2013.01); *B65D 27/16* (2013.01)

(58) Field of Classification Search

CPC ..... B65D 27/38; B65D 27/14; B65D 27/16

USPC ..... 383/5, 205, 206, 78, 84; 229/309, 310

See application file for complete search history.

(56) References Cited

U.S. PATENT DOCUMENTS

| | | | | |
|---|---|---|---|---|
| 3,368,740 | A * | 2/1968 | Rohde | B29C 37/0057 206/459.5 |
| 3,535,409 | A | 10/1970 | Rohde | |
| 3,565,737 | A | 2/1971 | Lefevre et al. | |
| 3,619,395 | A * | 11/1971 | Skendzic | B65D 75/66 206/459.1 |
| 3,625,270 | A * | 12/1971 | Skendzic | B65D 33/2508 383/204 |
| 4,303,710 | A | 12/1981 | Bullard et al. | |
| 4,387,170 | A * | 6/1983 | Kuhnel | C08J 9/0014 264/DIG. 5 |
| 4,522,854 | A * | 6/1985 | Sharps, Jr. | B29C 47/0021 229/87.05 |

(Continued)

FOREIGN PATENT DOCUMENTS

CN 103275377 9/2013

*Primary Examiner* — Jes F Pascua
(74) *Attorney, Agent, or Firm* — Senniger Powers LLP

(57) ABSTRACT

An envelope has an envelope body formed by opposing panels that define an interior and an opening. A closure is joined to and extends up from the top margin of one panel. The envelope is configured such that the interior surface of the closure is sealable to the other panel to permanently close the envelope opening. The closure includes a closure panel and a tear band coextruded with the closure panel. The tear band is composed of a polymeric material having lower tear strength than the material of the closure panel. The tear band defines a zone of weakness extending along the width of the closure for opening the closure by tearing along the zone of weakness after it is permanently closed.

22 Claims, 9 Drawing Sheets

(56) References Cited

U.S. PATENT DOCUMENTS 4,744,674 A * 5/1988 Nocek ..... B65B 43/12 383/209
4,759,643 A * 7/1988 Canno ..... B65D 27/16 383/100
4,855,168 A * 8/1989 Imaizumi ..... B65D 75/66 206/161
5,000,992 A 3/1991 Kelch
5,035,328 A 7/1991 Kim
5,045,264 A 9/1991 Kirksey
5,102,234 A * 4/1992 Levy ..... A61B 10/0096 383/209
5,135,790 A 8/1992 Kaplan et al.
5,470,419 A 11/1995 Sasaki et al.
5,954,431 A * 9/1999 Fabel ..... B42D 15/08 229/313
5,965,254 A 10/1999 Christopherson et al.
6,012,844 A * 1/2000 Huseman ..... B65D 33/20 383/209
6,054,209 A 4/2000 Imanishi et al.
6,149,302 A * 11/2000 Taheri ..... B65D 33/2533 383/203
6,202,260 B1 * 3/2001 Clune ..... A44B 18/0084 24/30.5 R
6,217,216 B1 * 4/2001 Taheri ..... B29C 47/0023 383/207
6,354,739 B1 3/2002 Sheehan, Jr. et al.
8,562,216 B2 10/2013 Kendall et al.
9,238,526 B2 * 1/2016 Anzini ..... B29C 44/04
2003/0064181 A1 4/2003 Ingraham
2003/0217943 A1 * 11/2003 Sklar ..... A61B 10/0096 206/438
2005/0100753 A1 5/2005 Reese et al.
2007/0297702 A1 12/2007 Zaggia et al.
2010/0205909 A1 8/2010 Zimmerman et al.
2011/0162329 A1 7/2011 So
2013/0089280 A1 4/2013 Tseng et al.
2013/0224346 A1 8/2013 Cheema et al.
2014/0065382 A1 3/2014 Koehn et al.
2015/0259103 A1 * 9/2015 Chen ..... B29D 5/10 383/63
2016/0016694 A1 * 1/2016 Tseng ..... B65D 33/2508 383/204

* cited by examiner

TEARABLE CONTAINER CLOSURE AND ENVELOPE COMPRISING SAME

REFERENCE TO RELATED APPLICATION

This application claims priority to U.S. Provisional Application Ser. No. 62/208,288 filed on Aug. 21, 2015, the entire content of which is incorporated by reference.

FIELD

The present disclosure generally relates to closures for containers such as envelopes and more particularly to a closure with a coextruded tear band for opening the container after closing.

BACKGROUND

In some circumstances, it is desirable to close a container permanently such that any subsequent opening of the container causes destructive evidence of the container having been opened. Generally, it is also desirable for these types of containers to be easily openable in a controlled manner that allows unobstructed access to container contents. Envelopes typify these types of containers.

SUMMARY

In one aspect, an envelope adapted to be permanently closed and later opened comprises a front panel and a rear panel having top, bottom, and opposite side edge margins. The front and rear panels are joined together along the bottom and side edge margins and are unjoined along the top edge margins. The joined edge margins and the panels define an envelope interior and the unjoined top edge margins define an envelope opening in communication with the envelope interior. A closure has a top edge margin, a bottom edge margin joined to the top edge margin of the rear panel, and a height extending from the bottom edge margin of the closure to the top edge margin, the closure has opposite sides and a width extending from one to the other of the opposite sides. The closure has an interior surface, an exterior surface, and a thickness extending from the exterior surface to the interior surface. The envelope is configured such that the interior surface of the closure is sealable to the front panel of the envelope to permanently close the envelope opening. The closure comprises a closure panel extending along the width of the closure and defining at least a portion of each of the exterior and interior surfaces of the closure. The closure panel is formed of a first polymeric material having a tear strength. A tear band is coextruded with the closure panel to form the closure. The tear band extends along the width of the closure at a location spaced apart from the top of the closure along the height of the closure and is formed of a second polymeric material having tear strength that is lower than the tear strength of the first polymeric material.

In another aspect, an envelope adapted to be permanently closed and later opened comprises a front panel and a rear panel having top, bottom, and opposite side edge margins. The front and rear panels are joined together along the bottom and side edge margins and are unjoined along the top edge margins. The joined edge margins and the panels define an envelope interior and the unjoined top edge margins define an envelope opening in communication with the envelope interior. A closure has a top edge margin, a bottom edge margin joined to the top edge margin of the rear panel, and a height extending from the bottom edge margin of the closure to the top edge margin, the closure has opposite sides and a width extending from one to the other of the opposite sides. The closure has an interior surface, an exterior surface, and a thickness extending from the exterior surface to the interior surface. The envelope is configured such that the interior surface of the closure is sealable to the front panel of the envelope to permanently close the envelope opening. A closure panel extends along the width of the closure and defines at least a portion of each of the exterior and interior surfaces of the closure. The closure panel is formed of a first polymeric material. A tear band formed of a second polymeric material is coextruded with the closure panel to form a composite tearable section of the closure extending along the width of the closure along a segment of the height of the closure that is spaced apart below the top edge margin of the closure. Each of the tear band and the closure panel form a respective portion of the thickness of the closure along the tearable section. The first polymeric material comprises a polymer of a type and has a tear strength and a tensile strength at yield point; and the second polymeric material comprises a polymer of the same type as said polymer of the first polymeric material and has a tear strength that is less than the tear strength of the first polymeric material and a tensile strength at yield point that is greater than the tensile strength at yield point of the first polymeric material.

Other aspects and features will be apparent and/or pointed out hereinafter.

BRIEF DESCRIPTION OF THE DRAWINGS

Corresponding reference characters indicate corresponding parts throughout the drawings.

DETAILED DESCRIPTION

Figure 1:
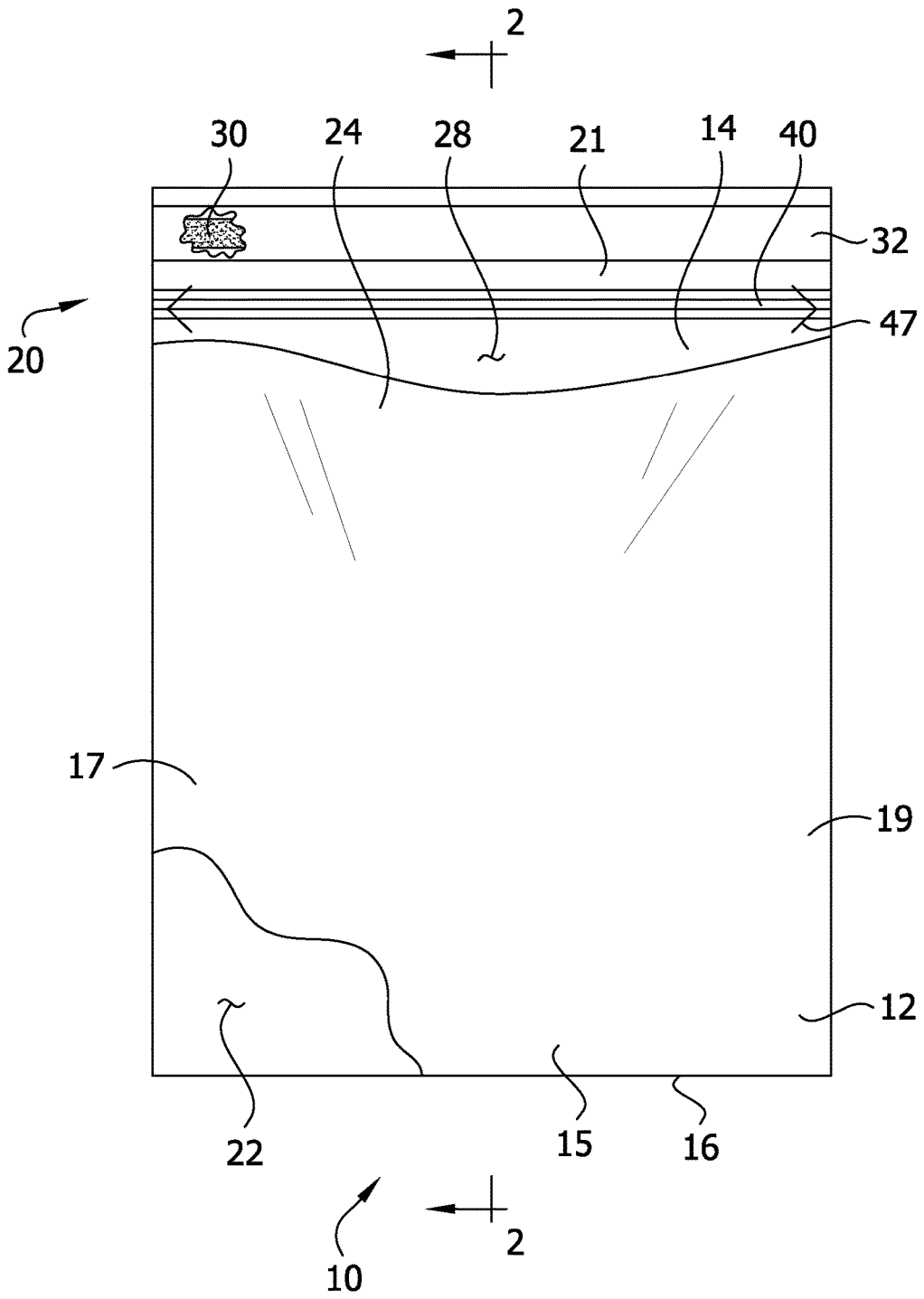
FIG. 1 is a fragmentary front elevation of an envelope with a front panel pulled open.

Referring to FIG. 1, a closeable and openable envelope (broadly, a container) is shown generally at 10. As will be discussed below, the envelope 10 is configured to be closed and subsequently opened. Features enable the envelope 10 to be opened with minimal force and effort, while also generating destructive evidence of the opening of the envelope.

The envelope 10 includes front and rear panels 12 and 14, respectively. Each panel 12, 14 is four-sided and has a top margin 24, bottom margin 15, and opposite side margins 17, 19. As used throughout the present disclosure with respect to the envelope, the terms defining relative locations and positions of structures and components of the envelope, including but not limited to the terms "top," "bottom," "side," "front," and "back," are meant to provide a point of reference for such components and structures as shown in the drawings, with the understanding that the respective relative locations of such components and structures will depend on the orientation of the envelope in use.

The panels 12, 14 are joined at the bottom margin 15 and side margins 17, 19 of the envelope 10. The top margins 24 of the panels are not joined. In one embodiment, the panels 12, 14 are formed as a single sheet of material that is folded at the bottom of the envelope 10 along a linear fold 16. Fusion lines join the side margins 17, 19. The panels 12, 14 can be joined in other manners within the scope of this invention. For example, in some embodiments, fusion lines join separate panel sheets 12, 14 along the bottom margin 15 and side margins 17, 19. In some embodiments, the end margins are joined to form a fluid tight, liquid tight, and/or gas tight seal. In other embodiments, the end margins can be joined without forming a seal. The joined panels 12, 14 define an envelope interior 22 for receiving items placed in the envelope 10. The top margins 24 of the panels 12, 14 define an opening 28 permitting access to the envelope interior 22 and its contents (the envelope opening is, broadly, in communication with the envelope interior).

A closure 20 is configured to close the envelope opening 28 to restrict access to the envelope interior 22. The closure 20 has a top edge margin, a bottom edge margin joined to the top edge margin of the rear panel 14, and a height extending from the bottom edge margin of the closure to the top edge margin. The closure 20 has opposite sides and a width extending from one side to the other side. In the illustrated embodiment, the width of the closure is coextensive with the width of the front and rear panels 12, 14. The closure has an interior surface, an exterior surface, and a thickness T (FIG. 2) extending from the exterior surface to the interior surface. As explained below, the envelope 10 is configured such that the interior surface of the closure 20 is sealable to the front panel 12 of the envelope to permanently close the envelope opening 28.

The closure 20 includes a closure panel 21 that is joined to the top margin 24 of the rear panel 14 and extends upward. The closure panel 21 comprises one or more layers of extruded polymer film. In certain embodiments, the closure panel 21 comprises a polymeric material, such as a low-density polyethylene (LDPE), a linear low density polyethylene (LLDPE), or another polymeric material with high tear strength. The closure panel 21 has opposite sides and a width extending between the sides. The sides of the closure panel 21 are substantially contiguous with the sides of the rear envelope panel 14 in the illustrated embodiment. In certain embodiments, the closure panel 21 and rear panel 14 are a one-piece, unitary film structure. For example, the closure panel 21 can be extruded with the rear panel 14 in the same extrusion process. In other embodiments the closure panel could be separately appended to the envelope 10 without departing from the scope of the invention.

As will be discussed in further detail below, in one or more preferred embodiments, the closure panel 21 and front and rear panels 12, 14 of the bag 20 are formed from a unitary sheet of extruded LDPE film. As is also discussed below, the LDPE film is preferably extruded in a process that produces relatively balanced tear strength properties in both the machine direction (MD) and cross direction (CD).

Figure 3:
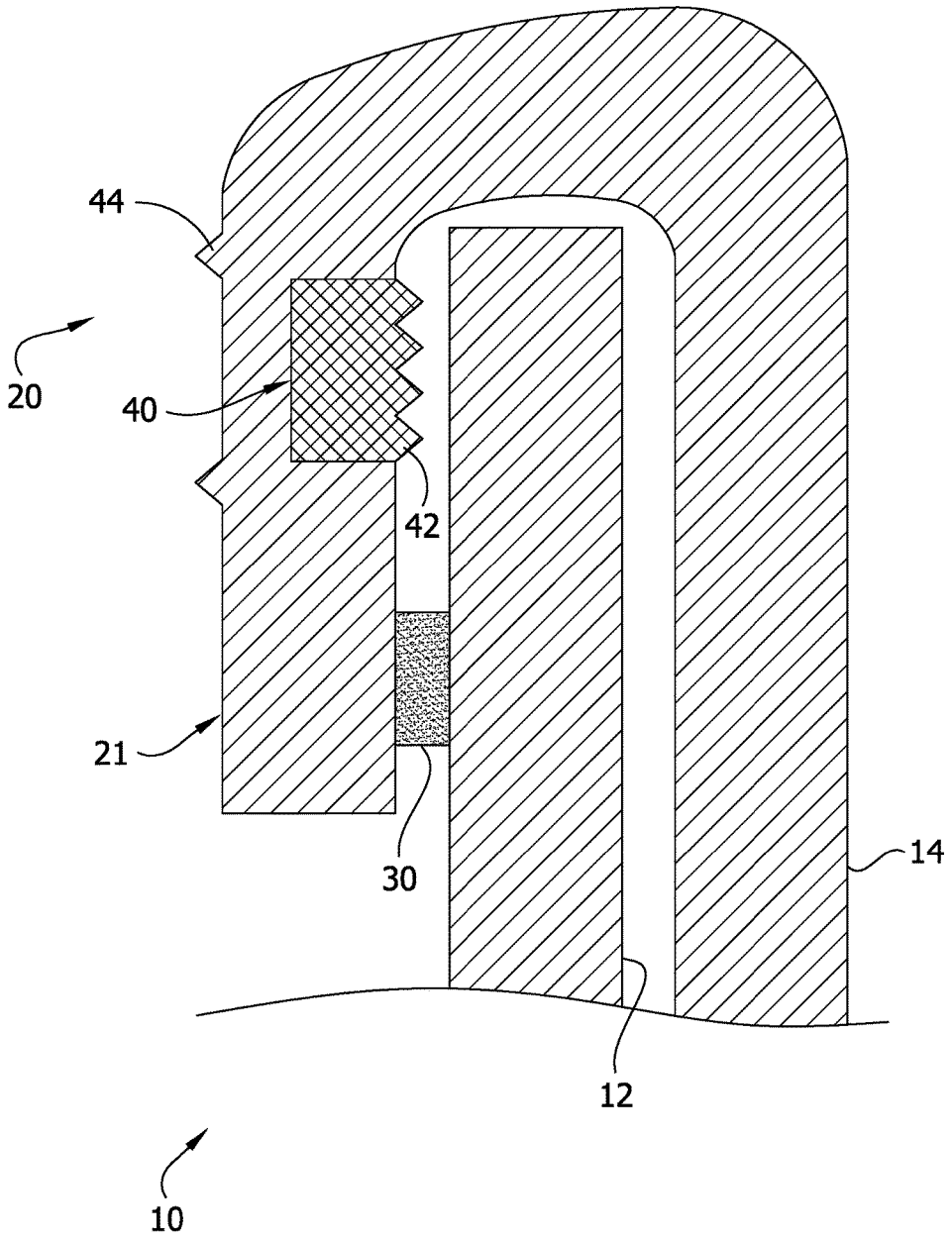
FIG. 3 is a fragmentary cross section of the envelop after being closed.

The closure panel 21 has an interior surface, which faces the envelope interior 22 and front panel 12, and an exterior surface (not shown in FIG. 1), which faces away from the rear panel 14 toward an exterior of the envelope 10. In the illustrated embodiment, the interior surface of the closure panel 21 defines a portion of the interior surface of the closure 20 and the exterior surface of the closure panel defines the entire exterior surface of the closure. To close the envelope 10, the closure panel 21 is configured to be folded over the front panel 12 so that the interior surface of the closure panel engages the exterior surface of the front panel (FIG. 3).

After being folded over, the closure panel 21 is configured to be fixed to the front panel 12 to "permanently" close the envelope opening 28. The closure 20 preferably permanently closes the envelope opening 28 such that opening the envelope 10 to access the contents of the envelope interior 22 entails damaging one of the panels 12, 14 or the closure such that the envelop cannot be reclosed and/or such that its having been opened is apparent. In the illustrated embodiment, a continuous band or layer of adhesive 30 extends along the interior surface of the closure panel 21 between the opposite sides. Other configurations of the band of adhesive are within the scope of the invention. A release liner strip 32 initially covers the adhesive band 30 to prevent inadvertent bonding with another surface. The release liner strip 32 preferably does not bond with the adhesive band and is removed before closing the envelope 10. Preferably, the adhesive band 30 is of a type that adheres strongly on contact with the material of the front panel 12. The adhesive band 30 is positioned so that, when the interior surface of the closure panel 21 engages the exterior surface of the front panel 12 in the closed configuration, the band contacts the front panel. To permanently close the envelope 10, the release strip 32 is removed and the closure panel 21 is folded over the front panel 12. The adhesive band 30 contacts the front panel 12 and bonds the closure panel 21 to the front panel. Once the adhesive band 30 bonds to the closure panel 21, the seal between the two components cannot be broken without at least some damage to the envelope.

Figure 2:
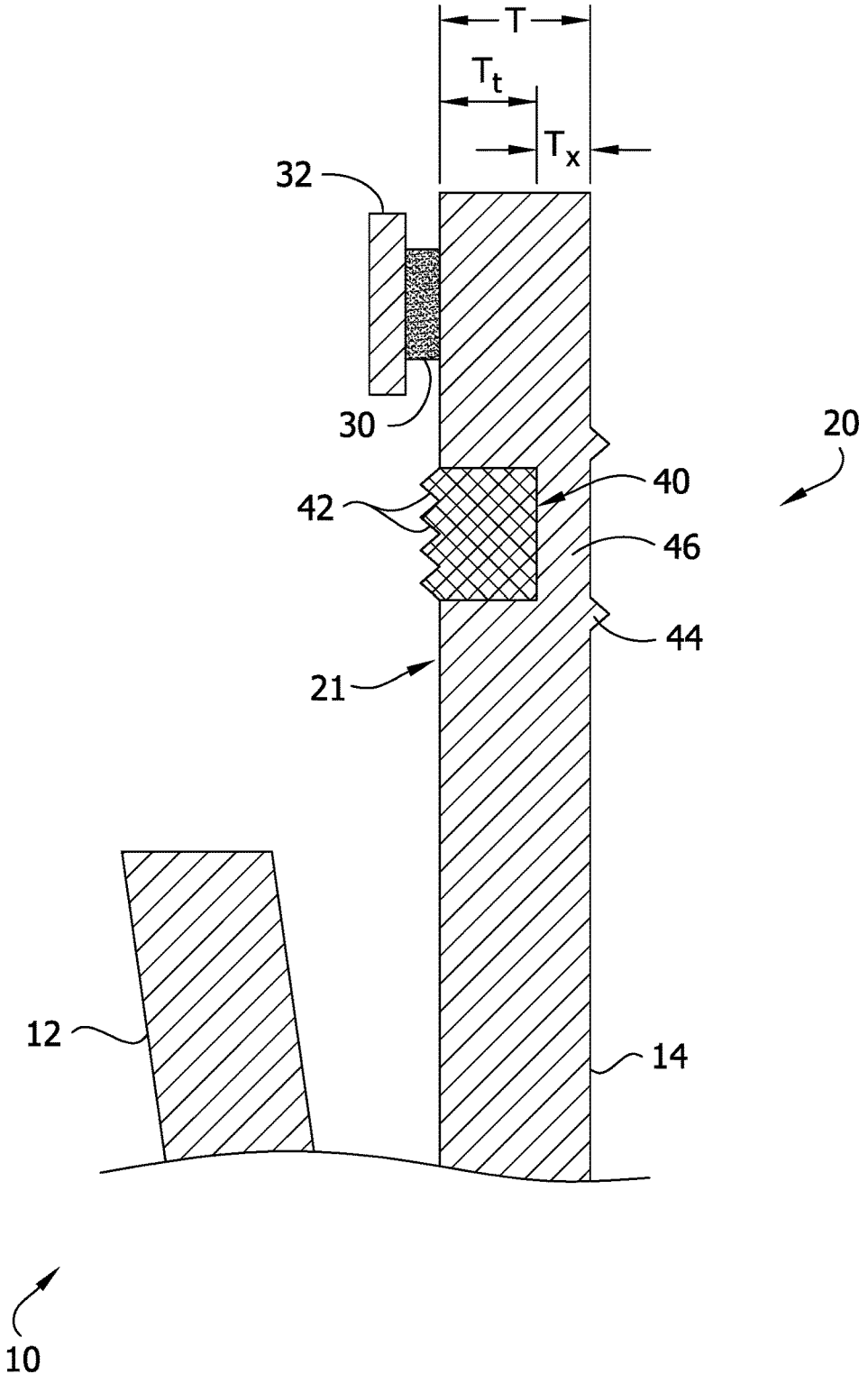
FIG. 2 is a fragmentary cross section of the envelope taken in the plane of line 2-2 of FIG. 1.

The closure 20 also includes a tear band 40 configured for easy opening of the envelope 10 after the adhesive band 30 permanently closes the envelope. As shown in FIG. 2, the tear band 40 is coextruded with the closure panel 21 to form the closure 20. In the illustrated embodiment, the tear band 40 extends from the interior surface of the closure 20 through more than half of the thickness of the closure. More specifically, the tear band 40 has an outboard side that forms a portion of the interior surface of the closure 20 and an opposite inboard side that is spaced apart inwardly from the outboard side along the thickness T of the closure. As will be discussed in further detail below, the tear band 40 is preferably composed of a polymeric material that is relatively easy to tear as compared with the material used for the closure panel 21. The tear band 40 thereby defines (e.g., is aligned with) a desired tear line for opening the envelope 10. As shown in FIG. 1, the tear band 40 extends widthwise along the closure 20 from one side of the closure panel 21 to the other. It will be understood that other configurations for tear bands can also be used without departing from the scope of the invention.

In one or more preferred embodiments, the closure 20 has a thickness T and the tear panel 40 extends from the inboard surface of the closure 20 through a portion of the thickness of the closure. In the illustrated embodiment, the closure 20 includes a closure panel portion 46 that also extends through a portion of the thickness of the closure 20 at the tear line. The closure panel portion 46 provides some resistance to tearing at the tear line to prevent the envelope 10 from being inadvertently opened. In the illustrated embodiment, the tear band 40 makes up a portion of the thickness T of the closure 20 at the tear line and the closure panel portion 46 makes up the rest of the thickness of the closure. The tear band has a thickness $T_t$ and the closure panel portion 46 has a thickness $T_x$. In one or more preferred embodiments, the thickness $T_t$ of the tear band 40 is from about 25% to about 95% or from about 50% to about 80% of the thickness T of the closure 20. In certain embodiments, the thickness $T_x$ of the closure panel portion 46 is from about 5% to about 50% of the thickness T of the closure 20.

As mentioned above, the tear band 40 is preferably coextruded with the closure panel 21. Other methods of forming the closure 20 may also be used without departing from the scope of the invention. In a preferred embodiment, the tear band 40 is coextruded with the closure panel 21 and front and rear envelope panels 12, 14 in a blown film process. For example, in one embodiment, the tear band 40 comprises an HDPE and the closure panel 21, front envelope panel 12, and rear envelope panel 14 comprise a unitary LDPE film that is coextruded in the same process as the tear band. Preferably, the extrusion process is oriented so that the envelope 10 has a widthwise oriented MD (i.e., the MD extends from the first side 17 to the second side 19 of the envelope) and a vertically oriented CD (i.e., the CD extends from the bottom end 15 to the top end of the envelope). For example, in one or more embodiments, the envelope 10 is formed in a blown film coextrusion process having a blow up ratio of from about 2 to about 3 (e.g., about 2.3). In certain preferred embodiments, the coextrusion process is performed at a temperature of from about 300° to about 400°.

When coextruding the tear band 40 and closure panel 21, it is generally preferable to use a polymeric material for the panel and a polymeric blend for the tear band that includes a polymer of the same type as is used for the polymeric material of the panel to promote bonding between the tear band and closure panel. For example, if the panel 21 is made from a polyethylene polymer, it is preferable for the tear band 40 to be made from a polymeric blend partially composed of a polyethylene polymer and another type of polymer. If the panel 21 is made from a polypropylene polymer, it is preferable for the temporary tear band 40 to be made from a polymeric blend partially composed of a polypropylene polymer and another type of polymer. If the panel 21 is made from a polybutylene polymer, it is preferable for the temporary tear band 40 to be made from a polymeric blend partially composed of a polybutylene polymer and another type of polymer. So, for example, in one embodiment the panel has a first polymeric composition and the tear band has a second polymeric composition which comprises the first composition and another type of polymer of between about 1 and about 75 wt %, such as between about 15 and about 35 wt %. When coextruding the tear band 40 and closure panel 21, it is generally preferable to use a polymeric material for the panel and a polymeric blend for the tear band that includes a polymer of the same type as is used for the polymeric material of the panel to promote bonding between the tear band and closure panel. For example, if the panel 21 is made from a polyethylene polymer, it is preferable for the tear band 40 to be made from a polymeric blend partially composed of a polyethylene polymer and another type of polymer. If the panel 21 is made from a polypropylene polymer, it is preferable for the temporary tear band 40 to be made from a polymeric blend partially composed of a polypropylene polymer and another type of polymer. If the panel 21 is made from a polybutylene polymer, it is preferable for the temporary tear band 40 to be made from a polymeric blend partially composed of a polybutylene polymer and another type of polymer. So, for example, in one embodiment the panel has a first polymeric composition and the tear band has a second polymeric composition which comprises the first composition and another type of polymer of between about 1 and about 75 wt %, such as between about 15 and about 35 wt %. For example, the first polymeric material and the second polymeric material can comprise a polymer of the same type and the second polymeric material can comprise a polyethylene-foaming agent blend.

The tear band 40 and closure panel 21 are composed of materials that promote tearing of the closure 20 along the tear band 40 in a controlled fashion. In preferred embodiments, the tear band 40 comprises a material having lower tear strength than the closure panel 21 but relatively high tensile strength. For example, in one embodiment, the tear band 40 comprises a high density polyethelyene (HDPE) or another polyethylene blend and the closure panel 21 comprises an LDPE. In one example, the envelope 10 is constructed from a coextruded blown film having an LDPE layer (e.g., that forms the panels 12, 14, 21) and an HDPE layer (e.g., that forms the tear band 40), wherein the LDPE and HDPE layers have the physical characteristics shown in Table 1 below.

TABLE 1

Physical Properties of Coextruded Film Formed in Exemplary Process

| Film Layer | Tear Strength in MD (g/mil) | Tear Strength in CD (g/mil) | Tensile Strength in MD at Break Point (psi) | Tensile Strength in MD at Yield Point (psi) |
|---|---|---|---|---|
| HDPE | 13 | 64 | 3,343 | 4,299 |
| LDPE | 167 | 194 | 3,035 | 1,810 |

Referring to Table 1, in an exemplary embodiment, the tear band 40 is coextruded from an HDPE material having the physical characteristics of the HDPE layer and the panels 12, 14, 21 are coextruded from an LDPE material having the physical characteristics of the LDPE layer. This exemplary embodiment has certain preferred material characteristics that can be achieved using other materials and manufacturing processes. For example, in one or more embodiments, the coextruded tear band 40 has a low tear strength in the MD. By comparison, the panels 12, 14, 21 have a much higher tear strength in the MD and a more balanced tear strength in the CD. The relatively low tear strength of the tear band 40 as compared with the closure panel 21 promotes tearing along the tear band 40, as opposed to another portion of the closure 20. Although the tear band 40 has a low tear strength in the MD, it has a relatively high tensile strength at the break point and yield point in the MD. For example, in one or more embodiments, the tear band 40 has a higher tensile strength at yield point than that of the panels 12, 14, 21. In certain embodiments, the tear band 40 also has a higher tensile strength at break point than that of the panels 12, 14, 21. The relatively high tensile strength of the tear band 40 as compared with the closure panel 21 ensures that the force needed to initiate tearing of the tear band 40 is also sufficient to initiate tearing of the closure panel 21 along the portion 46 that is aligned with the tear band.

Thus, it can be seen that the tear band 40 and the closure panel 21 form a composite tearable section that extends along the width of the closure 20 along a segment of the height of the closure that is spaced apart from the top edge margin of the closure. Preferably, the tensile force at the yield point F1 of the composite tearable section of the closure 20, which includes the tear band 40 and the closure panel portion 46, is larger than the tear force F2 required to tear open the closure along the desired tear line. The tensile strength at the yield point P of the composite portion of the closure 20 is the combined tensile strength of the tear band 40 and panel portion 46, which is a measurement of force per unit area. Assuming the closure 20 has a width W and a thickness T, the tensile force at the yield point F1 can be calculated according to Equation 1 below. The tear strength Q of the composite portion of the closure 20 is a measurement of the force per unit thickness required to form one tear line along the closure. In the illustrated embodiment, the tear force F2 required to tear open the envelope 10 is twice the tear strength of the composite material because two tear lines are formed when opening the closure. Thus, the tear force F2 can be calculated according to Equation 2 below. The ratio R of the tensile force at the yield point F1 and the tear force F2 is calculated according to Equation 3 below. In one or more preferred embodiments R is at least 3, for example from about 3 to about 150, from about 4 to about 75, or from about 7 to about 50. The tensile strength at the yield point P and tear strength Q of the composite portion of the closure 20 can be adjusted by selecting the proper materials for the tear band 40 and closure panel 21. The tensile force at yield point F1 and tear force F2 can be further adjusted by selecting the proper thicknesses for the tear band 40 and closure panel portion 46.

$$F1 = P * W * T \quad \text{Equation 1}$$

$$F2 = 2 * Q * T \quad \text{Equation 2}$$

$$R = \frac{F1}{F2} \quad \text{Equation 3}$$

In certain embodiments, the tear band 40 is composed of an immiscible polymer blend. An immiscible polymer blend has domains in the material that are rich in one or the other of the immiscible polymers in the blend. Whereas a miscible polymer blend or a single polymer is a homogenous material, immiscible polymer blends are heterogeneous. Weak material bonding occurs at interfaces between domains of the different polymers in an immiscible polymer blend. Although the weak material bonding produces a material that has a relatively weak tear strength, it is believed that immiscible polymer blends retain relatively strong tensile strength, especially at the yield point. Though immiscible polymer blends are a suitable material for the tear band 40, it is contemplated that other materials of relatively low tear strength can also be used without departing from the scope of the invention. In use, the tear band 40 is configured for controlled opening of the closure 20 along a tear line. As shown in FIG. 1, the tear line extends along the tear band 40 widthwise between the sides of the closure 20.

As shown in FIG. 2, the closure 20 includes a plurality of inner raised elements 42 that extend inward from the interior surface of the enclosure. In a preferred embodiment, the raised elements 42 extend continuously along the length of the tear band 40, generally parallel to the tear line. Outer tear guides 44 extend outward from the exterior surface of the closure panel 21. In the illustrated embodiment, the outer tear guides 44 are positioned above and below the tear band 40 and the outboard ones of the inner raised elements 42 are positioned just inboard of the top and bottom tear band edges. As the closure 20 is torn open, the inner raised elements 42 and outer tear guides 44 direct the tearing along lines positioned slightly inboard of the tear guides, between the outboard inner raised elements and the tear guides. The inner raised elements 42 reinforce the tensile strength of the tear band 40. The inner raised elements 42 also inhibit the tearing from veering out of line with the tear band 40. This prevents the tear band from tearing in two before being torn across the width of the envelope 10. In one or more embodiments, the tear guides 42, 44 are formed in an extrusion process with the closure panel 21 and tear band 40. In addition to the tear band 40 and optional tear guides 42, 44, the closure 20 can also include perforations, scoring, embossments, etc. that create a zone of weakness along a desired tear line. Although the illustrated tear guides 42, 44 have triangular cross-sectional shapes, tear guides of other cross-sectional shapes can also be used without departing from the scope of the invention.

Figure 4A:
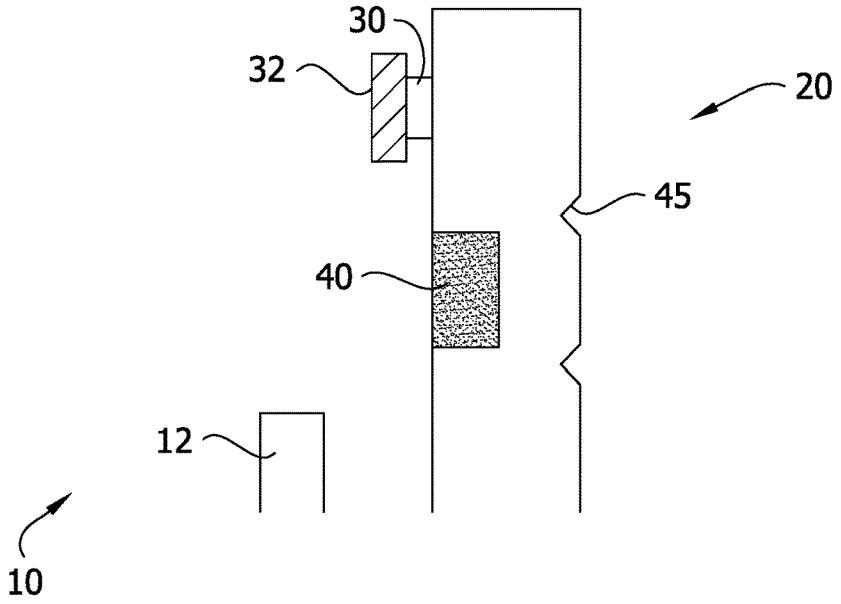
FIG. 4A is a fragmentary cross section similar to FIG. 2 of another embodiment of an envelope.
Figure 4B:
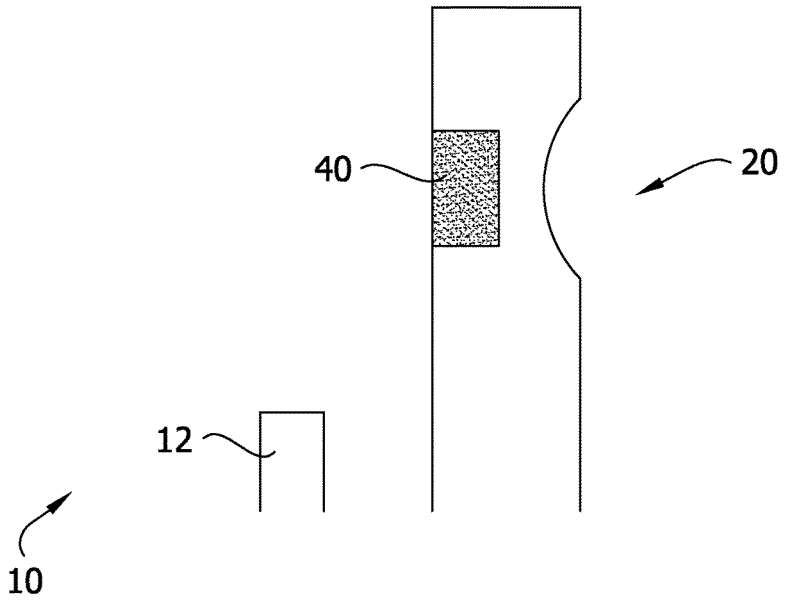
FIG. 4B is a fragmentary cross section similar to FIG. 2 of another embodiment of an envelope.

The closure 20 and tear band 40 may also be constructed differently to facilitate controlled opening of the envelope 10 along desired tear line(s) without departing from the scope of the invention. For example, as shown in FIG. 4A, in certain embodiments, the closure 40 includes outer tear guide grooves 45 that extend along the width of the envelope 10 outboard of the tear band 40. Like the outer tear guide projections 44, the outer tear guide grooves 45 direct tearing along lines positioned just outboard of the tear band 40 (e.g., substantially along the lines defined by the bottoms of the grooves 45). Referring to FIG. 4B, in another embodiment, the tear band 40 is extruded along a thin portion of the closure 20. A depression that is aligned with the tear band 40 and reduces the thickness of the closure 20 extends along the width of the closure. When the closure 20 is torn open, the depression guides tearing along the tear band 40. Still other tear band and closure constructions that facilitate tearing along the tear band can also be used without departing from the scope of the invention.

Referring to FIG. 1, the closure 20 can be easily opened using the tear band 20. The closure 20 includes two tear initiators 47 adapted to be grasped and pulled to initiate a tear along the tear band 40. In the illustrated embodiment, the tear initiators 47 comprise portions of the closure 20 bounded by chevron-shaped slots extending through the thickness of the closure. Other tear initiators may also be used without departing from the scope of the invention. When a user grasps the tear initiator 47 and begins to pull, two tears extending through the thickness of the closure 20 form between respective pairs of adjacent inner tear guide projections 42 with minimal resistance. The tear band 40, which extends through a significant portion of the thickness of the closure where the tears form, tears easily when the user pulls on the tear initiator 47. With continued pulling, the closure 20 tears along two parallel tear lines that bound a tear strip (e.g., a pulled away portion of the closure) including a portion of the tear band 40. The user can pull the tear strip to widen the opening of the closure 20 until the tear lines reach the slots bounding the opposite tear initiator, at which point the tear strip is optionally removed from the envelope 10.

As can be seen, the closure 20 enables a container such as the envelope 10 to be permanently closed and subsequently opened in a destructive manner. Robust materials can be used for the closure 20 and the envelope so that the envelope is not inadvertently opened. A coextruded tear band 40 with relatively low tear strength enables the robust envelope to be opened accurately along a desired tear line with minimal user effort.

Figure 5:
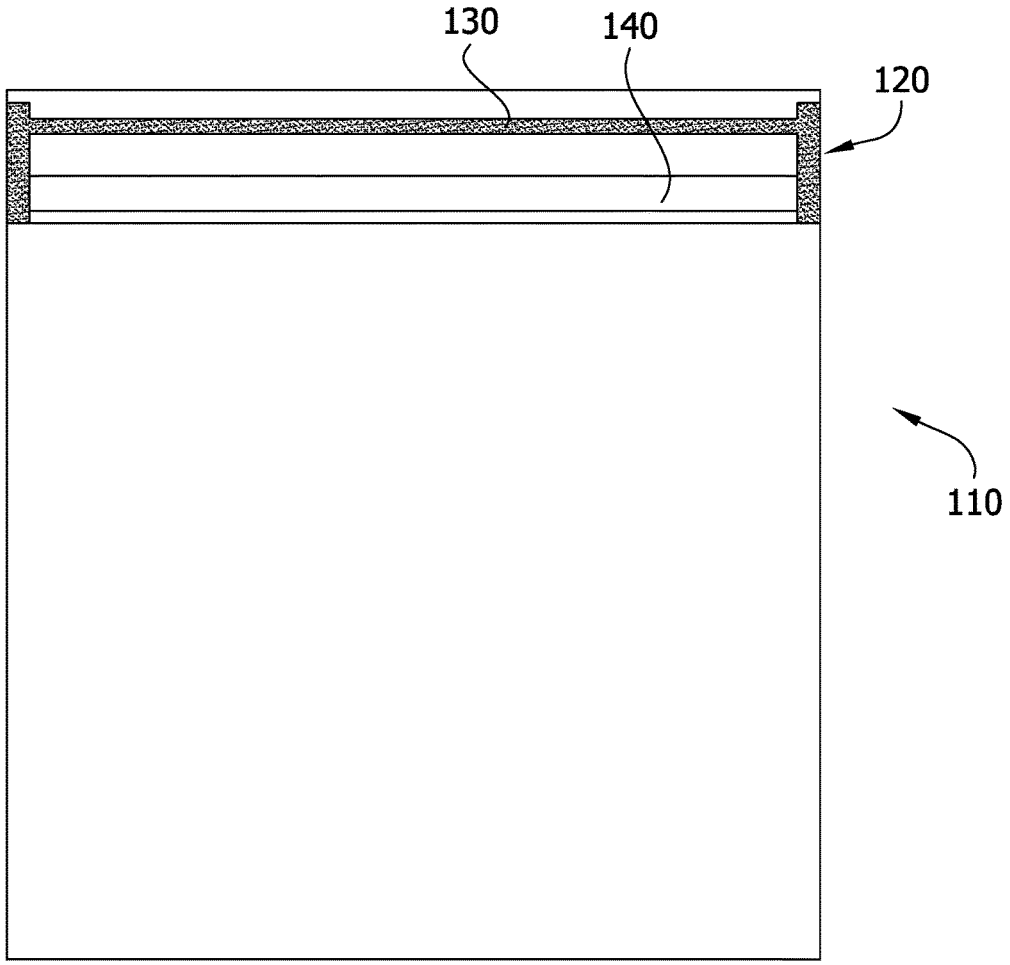
FIG. 5 is a front elevation of another envelope.

Referring to FIG. 5, another embodiment of an envelope 110 includes a closure 120 for closing an envelope opening. The closure 120 includes an adhesive band 130 formed along an inner surface. The closure 120 also includes a tear band 140 for opening the closure after it is used to close the envelope 10. A central portion adhesive band 130 extends widthwise between the opposite sides of the closure. Side portions of the adhesive band 130 extend lengthwise of the envelope 110 (vertically in FIG. 5) adjacent the opposite sides of the closure 120. The side portions of the adhesive band 130 extend from respective bottom ends beneath the fold line along which the closure 120 folds to close the envelope 110 to top ends above the central portion of the adhesive band. When the adhesive band 130 joins the closure to the front envelope panel, the closure 120 forms a watertight seal over the envelope opening. The side portions of the adhesive band 130 seal the length of the closure 120 folded over the front panel and the central portion seals the width of the closure between the side portions.

Figure 6:
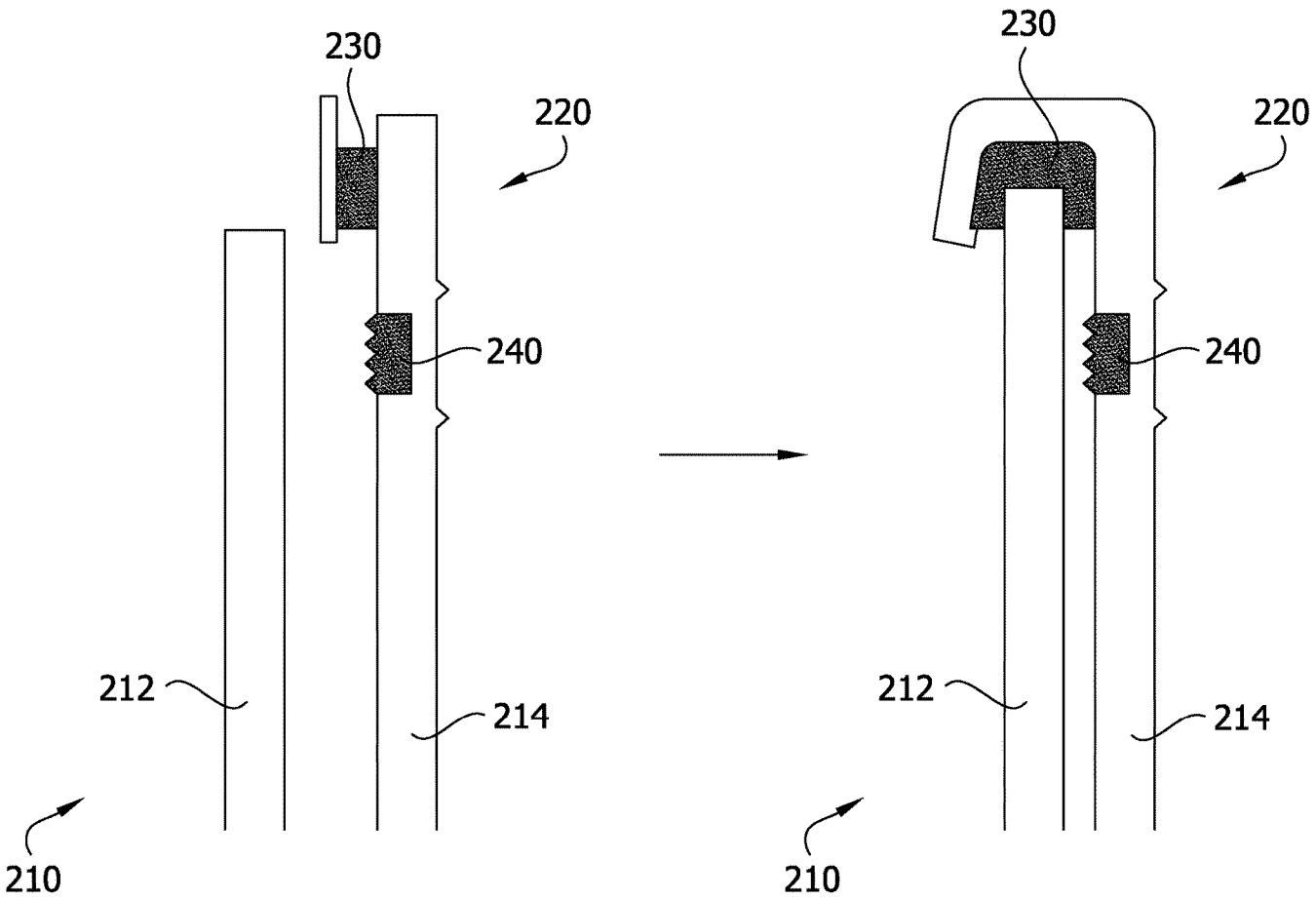
FIGS. 6-9 are fragmentary cross sections of other embodiments of envelopes.
Figure 7:
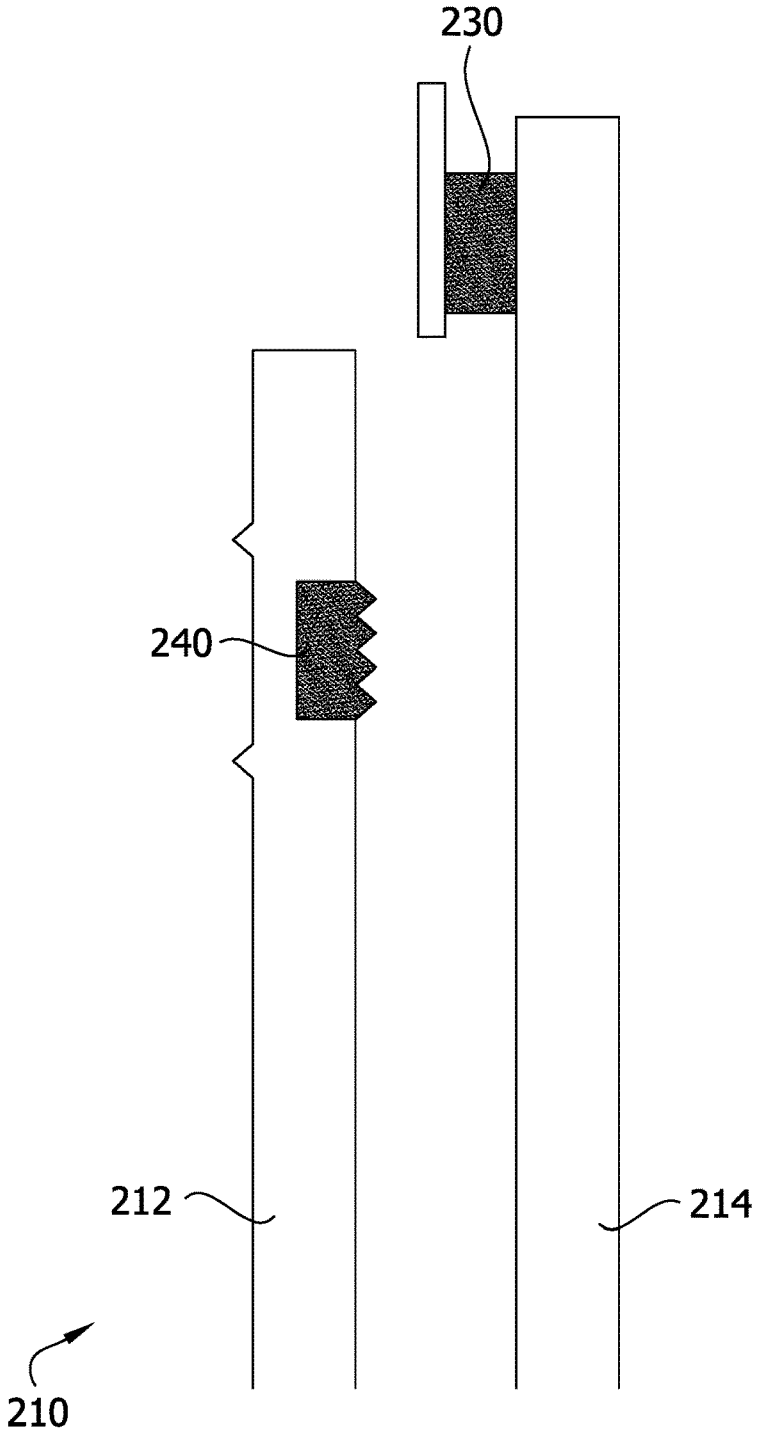

Referring to FIG. 6, in another embodiment of an envelope 210, the closure 220 includes an adhesive band 230 positioned to contact and seal to a top edge portion of a front envelope panel 212 when the envelope is closed. In the illustrated embodiment, the adhesive band 230 curls around a top edge portion of the front envelope 212 panel such that the adhesive band contacts and seals to an inward facing top edge margin, an upward facing top edge surface, and an outward facing top edge margin of the front panel. In one or more embodiments, the adhesive band seals against the entire width of the top edge portion of the front panel 212 so that the closure 220 forms a liquid tight seal over the envelope opening when closed. Like the previous envelope embodiments, a tear band 240 is coextruded with the rear panel 214 of the envelope 210 for opening the envelope after the envelope is closed. As shown in FIG. 7, the tear band 240 could also be formed on the front panel 212 of the envelope 210 without departing from the scope of the invention.

Figure 8:
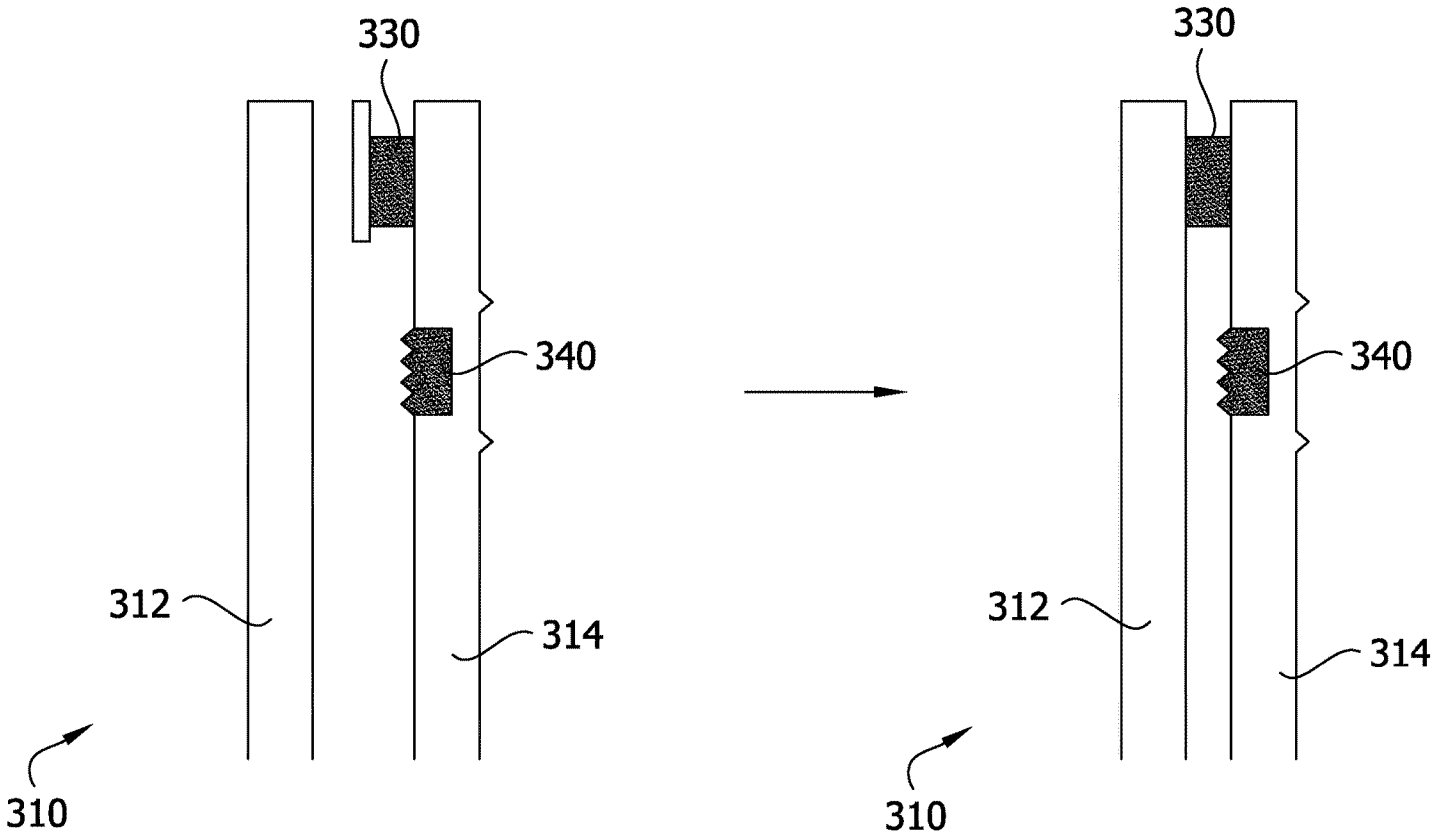
Figure 9:
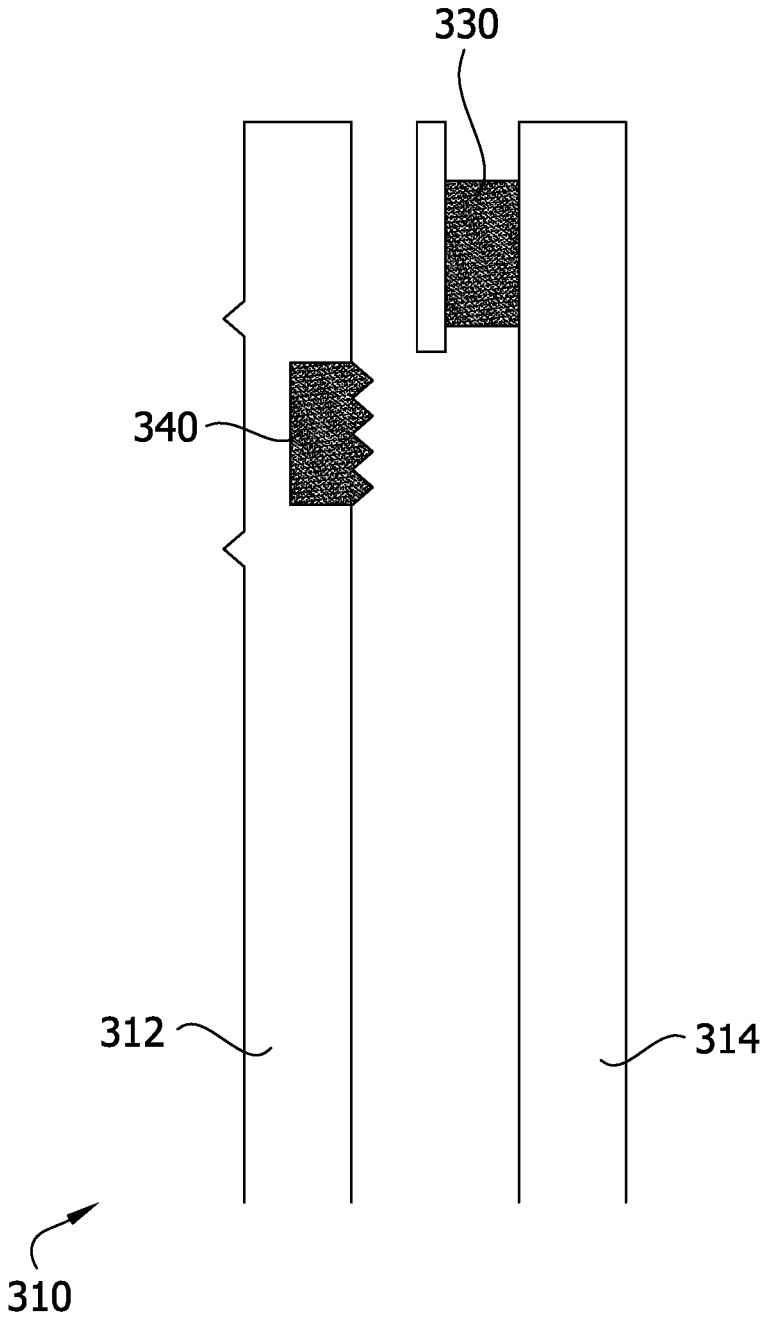

As shown in FIG. 8, in one or more embodiments, the envelope 310 does not have a closure panel that extends upward past the top edge of the front panel 312. In the illustrated embodiment, the top edges of the front panel 312 and the rear panel 314 are substantially aligned. An adhesive band 330 extends widthwise along the inner surface of the rear panel 314. To close the envelope 310, the adhesive band 330 is exposed and the top edge portions of the front and rear panels 312, 314 are squeezed together so that the adhesive band contacts and bonds with the inner surface of the front panel. In a preferred embodiment, the adhesive band 330 extends from one side edge of the envelope 310 to the other such that the adhesive band forms a watertight seal over the envelope opening when the envelope is closed. Like the previous envelope embodiments, the envelope 330 includes a tear band 340 coextruded with the rear panel 312 and configured for opening the envelope 210 after the envelope is closed. As shown in FIG. 9, the tear band 340 could also be formed on the front panel 312 of the envelope 310 without departing from the scope of the invention.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. An envelope adapted to be permanently closed and later opened, the envelope comprising:

a front panel and a rear panel having top, bottom, and opposite side edge margins, the front and rear panels being joined together along the bottom and side edge margins and being unjoined along the top edge margins, the joined edge margins and the panels defining an envelope interior and the unjoined top edge margins defining an envelope opening in communication with the envelope interior; and a closure having a top edge margin, a bottom edge margin joined to the top edge margin of the rear panel, and a height extending from the bottom edge margin of the closure to the top edge margin, the closure having opposite sides and a width extending from one to the other of the opposite sides, the closure having an interior surface, an exterior surface, and a thickness extending from the exterior surface to the interior surface, the envelope being configured such that the interior surface of the closure is sealable to the front panel of the envelope to permanently close the envelope opening, the closure comprising:

a closure panel extending along the width of the closure and defining at least a portion of each of the exterior and interior surfaces of the closure, the closure panel being formed of a first polymeric material having a tear strength, and a tear band coextruded with the closure panel to form the closure, the tear band extending along the width of the closure at a location spaced apart from the top of the closure along the height of the closure and being formed of a second polymeric material having tear strength that is lower than the tear strength of the first polymeric material;

wherein the tear band overlies a portion of the closure panel along a segment of the height of the closure to form a composite tearable section of the closure including the tear band and said portion of the closure panel; and wherein the tear band has a thickness which is from about 50% to about 80% of the thickness of the closure.

2. An envelope as set forth in claim 1 wherein the tear band has an outboard side that defines a portion of one of the interior surface and the exterior surface of the closure panel.

3. An envelope as set forth in claim 2 wherein the tear band has an inboard side and a thickness extending from the outboard side to the inboard side, the thickness of the tear band being less than the thickness of the closure.

4. An envelope as set forth in claim 1 wherein the first polymeric material and the second polymeric material comprise a polymer of the same type.

5. An envelope as set forth in claim 4 wherein the first polymeric material comprises one of low-density polyethylene and linear low-density polyethylene.

6. An envelope as set forth in claim 4 wherein the second polymeric material comprises a high density polyethylene.

7. An envelope as set forth in claim 4 wherein the second polymeric material comprises a polyethylene-foaming agent blend.

8. An envelope as set forth in claim 4 wherein the second polymeric material comprises said polymer of the same type as said polymer of the first polymeric material and another polymer of another type, said other polymer of said other type being between about 1 and about 75 wt % of the second polymeric material.

9. An envelope as set forth in claim 8 wherein said other polymer of said other type is between about 15 and about 35 wt % of the second polymeric material.

10. An envelope as set forth in claim 9 wherein the first polymeric material has a tensile strength at yield point and the second polymeric material has a tensile strength at yield point, the tensile strength at yield point of the second polymeric material being greater than the tensile strength at yield point of the first polymeric material.

11. An envelope as set forth in claim 1 wherein the second polymeric material comprises an immiscible polymer blend.

12. An envelope as set forth in claim 1 wherein a tensile force required to reach a yield point of the composite tearable structure is greater than a tear force required to tear the composite tearable structure along the width the of the closure.

13. An envelope as set forth in claim 12 wherein a ratio of said tensile force to said tear force is at least about 3.

14. An envelope as set forth in claim 13 wherein said ratio is from about 4 to about 75.

15. An envelope as set forth in claim 1 wherein the tear band has an outer side and forming at least one raised element protruding from the outer side along the width of the closure.

16. An envelope as set forth in claim 1 wherein the closure panel comprises first and second tear guides formed in one of the interior surface and the exterior surface of the closure, the first tear guide being spaced apart above the tear band and the second tear guide being spaced apart below the tear band, each of the first and second tear guides comprising a formation extending along the width of the closure panel selected from the group of formations consisting of one of a projection extending outward from said one of the interior surface and the exterior surface and a depression formed in said one of the interior surface and the exterior surface.

17. An envelope as set forth in claim 1 wherein the closure includes a tear guide formation extending along the width of the closure and configured to guide tearing of the closure along a tear line at a location aligned along the height of the closure with the tear band, the closure further comprising at least one raised element extending along the width of the closure adjacent the tear line configured to inhibit the closure from tearing in a direction transverse to the tear line when the closure is being torn along the tear line.

18. An envelope as set forth in claim 17 wherein the tear guide formation comprises one of a groove, a depression, and a raised element.

19. An envelope as set forth in claim 17 wherein the tear guide formation is formed on one of the interior surface and the exterior surface of the closure and the raised element is formed on the other of the interior surface and the exterior surface of the closure.

20. An envelope as set forth in claim 17 wherein the tear band has a top edge and a bottom edge spaced apart along the height of the closure, the tear guide formation comprising a top tear guide formation defining a top tear line adjacent the top edge of the tear band, the closure further including a bottom tear guide formation extending along the width of the closure and configured to define at a bottom tear line spaced apart from the top tear line and located adjacent the bottom edge of the tear band.

21. An envelope as set forth in claim 20 wherein the at least one raised element comprises a plurality of raised elements spaced apart along the height of the closure between the top and bottom tear lines.

22. An envelope adapted to be permanently closed and later opened, the envelope comprising:

a front panel and a rear panel having top, bottom, and opposite side edge margins, the front and rear panels being joined together along the bottom and side edge margins and being unjoined along the top edge margins, the joined edge margins and the panels defining an envelope interior and the unjoined top edge margins defining an envelope opening in communication with the envelope interior; and a closure having a top edge margin, a bottom edge margin joined to the top edge margin of the rear panel, and a height extending from the bottom edge margin of the closure to the top edge margin, the closure having opposite sides and a width extending from one to the other of the opposite sides, the closure having an interior surface, an exterior surface, and a thickness extending from the exterior surface to the interior surface, the envelope being configured such that the interior surface of the closure is sealable to the front panel of the envelope to permanently close the envelope opening, the closure comprising:

a closure panel extending along the width of the closure and defining at least a portion of each of the exterior and interior surfaces of the closure, the closure panel being formed of a first polymeric material having a tear strength, and a tear band coextruded with the closure panel to form the closure, the tear band extending along the width of the closure at a location spaced apart from the top of the closure along the height of the closure and being formed of a second polymeric material having tear strength that is lower than the tear strength of the first polymeric material;

wherein the tear band overlies a portion of the closure panel along a segment of the height of the closure to form a composite tearable section of the closure including the tear band and said portion of the closure panel;

wherein the tear band has a thickness which is from about 25% to about 95% of the thickness of the closure;

wherein the tear band has a top edge and a bottom edge spaced apart along the height of the closure, the closure comprising a top tear guide formation extending along the width of the closure and defining a top tear line adjacent the top edge of the tear band, the closure further comprising a bottom tear guide formation extending along the width of the closure and defining a bottom tear line spaced apart from the top tear line and located adjacent the bottom edge of the tear band; and wherein the tear band has an outer side and comprises a plurality of raised elements protruding from the outer side and extending along the tear band, the plurality of raised elements being spaced apart along the height of the closure between the top and bottom tear lines.

* * * * *